US011173725B2

(12) United States Patent
Takami

(10) Patent No.: US 11,173,725 B2
(45) Date of Patent: Nov. 16, 2021

(54) LABEL PRINTER

(71) Applicant: SEIKO EPSON CORPORATION, Tokyo (JP)

(72) Inventor: Toru Takami, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/922,549

(22) Filed: Jul. 7, 2020

(65) Prior Publication Data

US 2021/0008896 A1 Jan. 14, 2021

(30) Foreign Application Priority Data

Jul. 10, 2019 (JP) ..... JP2019-128233

(51) Int. Cl.
*B41J 3/407* (2006.01)
*B65C 9/00* (2006.01)
*B41J 15/04* (2006.01)

(52) U.S. Cl.
CPC ..... *B41J 3/4075* (2013.01); *B41J 15/042* (2013.01); *B65C 9/0006* (2013.01)

(58) Field of Classification Search
CPC ..... B65C 9/0006
See application file for complete search history.

(56) References Cited

U.S. PATENT DOCUMENTS

2015/0367624 A1* 12/2015 Tokuda ..... B65C 9/0006 156/702
2018/0001663 A1 1/2018 Takami
2019/0061388 A1 2/2019 Kasai

FOREIGN PATENT DOCUMENTS

EP 3103637 A1 * 12/2016 ..... B32B 27/308
JP H10-016932 A 1/1998
JP 2018-002365 A 1/2018
JP 2019-043561 A 3/2019

* cited by examiner

*Primary Examiner* — Matthew G Marini
(74) *Attorney, Agent, or Firm* — Workman Nydegger

(57) ABSTRACT

A label printer includes a print head configured to perform printing on a label sheet, a transporting roller configured to transport the label sheet downstream, a peeling roller configured to transport a backing sheet in a direction different from a travelling direction of a label to peel the label from the backing sheet, and a control unit configured to control rotation of the transporting roller and rotation of the peeling roller, wherein when controlling a current value supplied to a peeling motor configured to rotate the peeling roller, the control unit supplies, to the peeling motor, a current value that is greater in an acceleration period for accelerating the rotation of the peeling roller than in any of a constant-speed period for rotating the peeling roller at a constant-speed and a deceleration period for decelerating the rotation of the peeling roller.

5 Claims, 8 Drawing Sheets

TB1

| MEDIUM WIDTH | CURRENT VALUE Ia | CURRENT VALUE Ib | CURRENT VALUE Ic |
|---|---|---|---|
| THw OR SMALLER | Ia1 | Ib1 | Ic1 |
| GREATER THAN THw | Ia2 | Ib2 | Ic2 |

FIG. 8A

TB2

| TRANSPORT SPEED | CURRENT VALUE Ia | CURRENT VALUE Ib | CURRENT VALUE Ic |
|---|---|---|---|
| LOW-SPEED MODE | Ia3 | Ib3 | Ic3 |
| HIGH-SPEED MODE | Ia4 | Ib4 | Ic4 |

FIG. 8B

TB3

| TRANSPORT FORCE F4 | CURRENT VALUE Ia | CURRENT VALUE Ib | CURRENT VALUE Ic |
|---|---|---|---|
| THf OR SMALLER | Ia5 | Ib5 | Ic5 |
| GREATER THAN THf | Ia6 | Ib6 | Ic6 |

FIG. 8C

LABEL PRINTER

The present application is based on, and claims priority from JP Application Serial Number 2019-128233, filed Jul. 10, 2019, the disclosure of which is hereby incorporated by reference herein in its entirety.

BACKGROUND

1. Technical Field

The present disclosure relates to a label printer.

2. Related Art

A label printer including a peeling device that peels a label of a label sheet from a backing sheet is known (see JP-A-2018-2365). In the peeling device disclosed in JP-A-2018-2365, a torque limiter serving as a driving force transmission mechanism is disposed between a driving motor and a driving roller for transporting the backing sheet for the purpose of peeling of the label. By keeping the torque generated by the driving roller at a constant value by the torque limiter, there is an advantage that even when the current input to the driving motor varies, the label sheet is transported at an appropriate torque amount and slippage between the transporting roller and the backing sheet is prevented.

However, the torque of the driving roller has a constant value even at the time of acceleration of the rotation of the driving roller from the stopped state to the state for transporting the backing sheet, and consequently it disadvantageously takes time until completion of the acceleration of the driving roller.

SUMMARY

A label printer includes a print head configured to perform printing on a label sheet including a label attached to a backing sheet, a transporting roller disposed upstream of the print head in a transport path of the label sheet, and configured to rotate in a state where the transporting roller is in contact with the label sheet to transport the label sheet downstream in the transport path, a peeling roller disposed downstream of the print head in the transport path, and configured to rotate in a state where the peeling roller is in contact with the backing sheet, the peeling roller being configured to transport the backing sheet in a direction different from a travelling direction of the label to peel the label from the backing sheet, and a control unit configured to control rotation of the transporting roller and rotation of the peeling roller. When controlling a current value supplied to a peeling motor that rotates the peeling roller to accelerate rotation of the peeling roller in a stopped state, to rotate the peeling roller at a constant speed after acceleration, and to decelerate and stop the rotation of the peeling roller, the control unit supplies the current value to the peeling motor such that the current value supplied in an acceleration period is greater than the current value in any of a constant-speed period and a deceleration period, the acceleration period being a period in which the rotation of the peeling roller is accelerated, the constant-speed period being a period in which the peeling roller is rotated at a constant speed, the deceleration period being a period in which the rotation of the peeling roller is decelerated.

BRIEF DESCRIPTION OF THE DRAWINGS

FIG. 8A is a diagram illustrating a current value table defining a current value corresponding to a medium width, FIG. 8B is a diagram illustrating a current value table defining a current value corresponding to a transport speed, and FIG. 8C is a drawing illustrating a current value table defining a current value corresponding to a minimum transport force required for label peeling.

DESCRIPTION OF EXEMPLARY EMBODIMENTS

An embodiment of the present disclosure will be described below with reference to the accompanying drawings. The drawings are merely exemplification for describing this embodiment. The drawings are exemplification, and therefore may not be accurate in ratio, may be inconsistent with one another, and may be partially omitted.

1. Device Configuration

Figure 1:
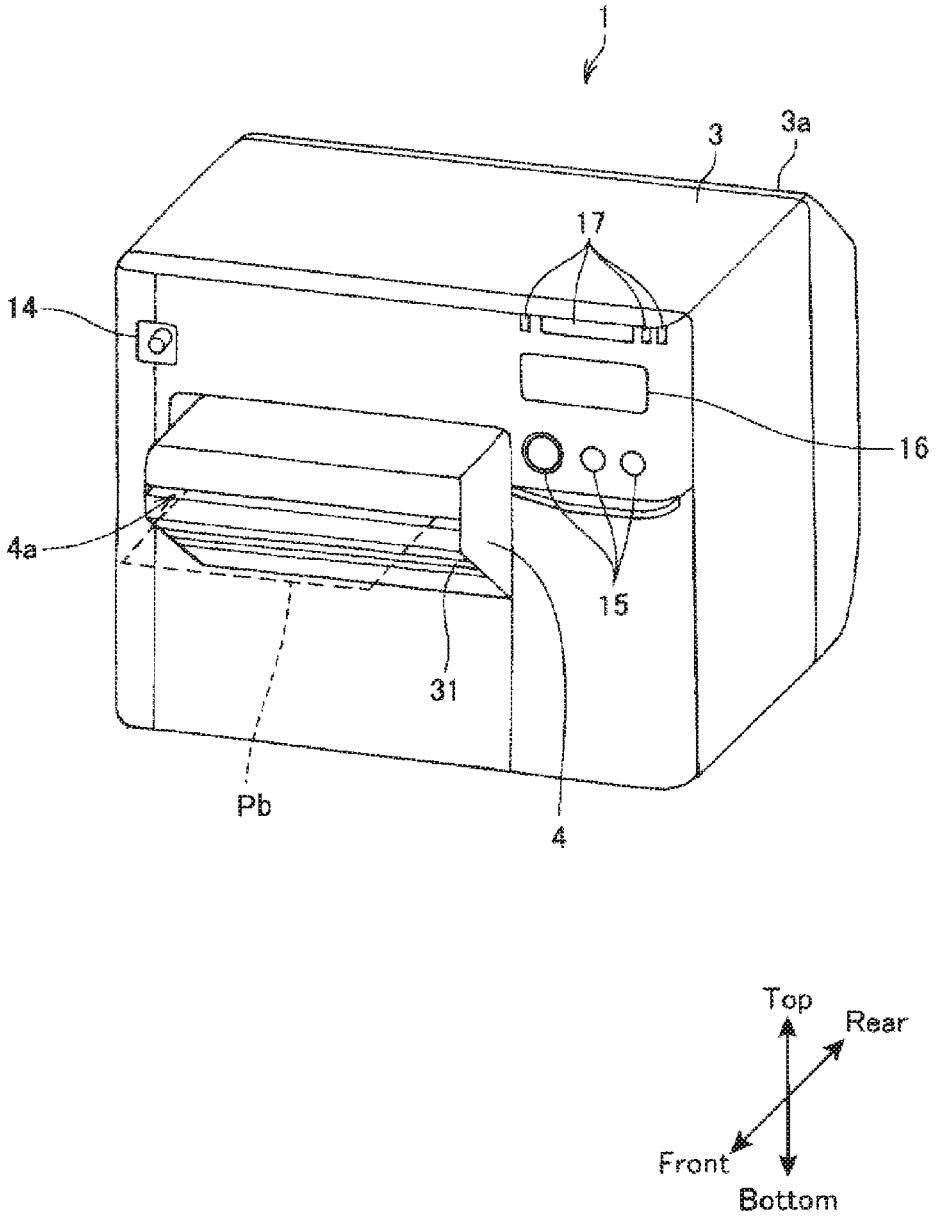
FIG. 1 is an external perspective view of a label printer.

FIG. 1 is an external perspective view illustrating a label printer 1 according to this embodiment.

Figure 2:
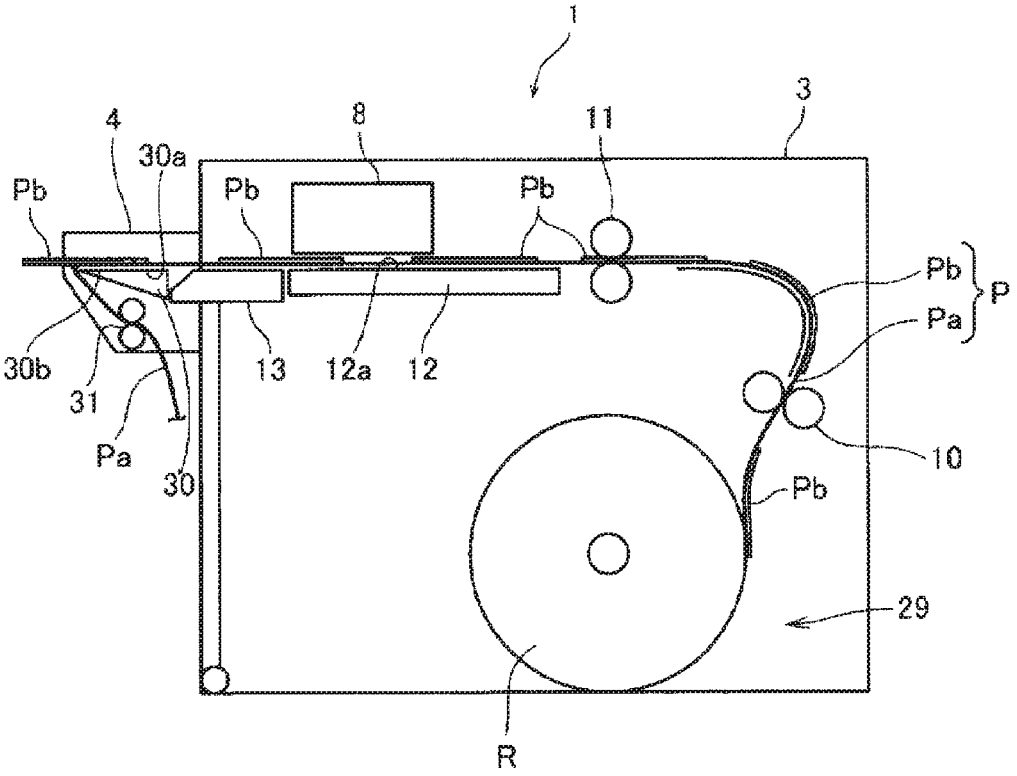
FIG. 2 is a schematic diagram illustrating a configuration of the label printer.

FIG. 2 is a schematic diagram illustrating a configuration of the label printer 1, and illustrates a schematic configuration of an interior of the label printer 1. Hereinafter, for convenience, the directions with respect to the label printer 1 will be described as "top", "bottom", "front", and "rear" illustrated in FIG. 1. The label printer 1 is a printer for printing characters, images, graphics, and the like by an ink-jet method using a label sheet P as a printing medium.

The label sheet P includes a backing sheet Pa and a plurality of labels Pb. The backing sheet Pa is a strip-shaped continuous paper. The surface of the backing sheet Pa is provided with releasability, and the labels Pb each of which is cut in a predetermined size are attached at an equal interval in the longitudinal direction of the backing sheet Pa. The material of the backing sheet Pa and the label Pb may be paper or a material other than paper. The backing sheet Pa may be referred to as a base member. The label sheet P is set in the label printer 1 as a roll sheet R wound in a roll shape.

The label printer 1 includes a printing unit 3 as a main body of the label printer 1, and a peeling unit 4. The peeling unit 4 may be integrally formed with the printing unit 3 on the front surface of the label printer 1, or may be a part that is detachably provided on the front surface of the printing unit 3. The peeling unit 4 is a device that performs a process of peeling the label Pb from the backing sheet Pa for the label sheet P printed by the printing unit 3, and is referred to also as a peeler. At the front surface of the peeling unit 4, an ejection port 4*a* through which the printed label sheet P or the label Pb that has been peeled from the backing sheet Pa is ejected is open. The label printer 1 can perform a non-peeling mode in which the printed label sheet P with the label Pb attached on the backing sheet Pa is ejected from the ejection port 4*a*, and a peeling mode in which the printed label Pb peeled from the backing sheet Pa is ejected from the ejection port 4*a*. In this embodiment, the description will be made based on the peeling mode.

The printing unit 3 has a configuration in which a function unit including a print head 8 is housed in a case 3*a* having a box-like shape. As illustrated in FIG. 1, a power switch 14, a plurality of operation buttons 15, a display 16, a plurality of lamps 17, and the like are provided in the surface of the case 3*a*. The power switch 14 is a switch for on/off of the power of the label printer 1. The operation button 15 is a button for receiving various operations performed by a user for the label printer 1. The display 16 is configured with an LCD or the like, and displays various information such as an operating state of the label printer 1. The display 16 may have a function of a touch panel that receives user operations. The lamp 17 includes a light source such as an LED, and turns on or off, or blinks in accordance with the operating state of the label printer 1 or the like so as to function as an indicator.

The printing unit 3 performs printing on each label Pb of the label sheet P with each function unit including the print head 8 housed in the case 3*a* based on print data and commands transmitted from a host computer (not illustrated). In addition, the printing unit 3 transports the label sheet P along the transport path of the label sheet P. Hereinafter, the upstream and downstream transporting paths are referred to simply as upstream and downstream.

As illustrated in FIG. 2, the printing unit 3 includes a housing 29, a feeding roller 10, a transporting roller 11, a platen 12, a guide 13, and a print head 8. The transporting roller 11 and the feeding roller 10 may be collectively referred to as a transport unit. The housing 29 is a space for housing the roll sheet R, and the label sheet P is fed from the roll sheet R set in the housing 29. The feeding roller 10, which is composed of a pair of rollers facing each other, pulls the label sheet P fed from the roll sheet R and transports the label sheet P downstream. The transporting roller 11, which is composed of a pair of rollers facing each other, sandwiches the label sheet P transported by the feeding roller 10, and transports the label sheet P toward the downstream print head 8.

The transporting roller 11 is coupled, directly or with a gear, a belt or the like therebetween, to a transport motor 21 described later, and is rotated by the power of the transport motor 21. The feeding roller 10 is coupled to the transport motor 21 together with the transporting roller 11 and is rotated by the power of the transport motor 21. Note that the feeding roller 10 may be configured to be driven by a motor (not illustrated) that is different from the transport motor 21. In addition, the feeding roller 10 is not an essential configuration.

The platen 12 is disposed downstream of the transporting roller 11 in the transport path of the label sheet P. A platen surface 12*a*, which is the top surface of the platen 12, supports the label sheet P from below by making contact with the backing sheet Pa of the label sheet P. It is also possible to adopt a configuration in which the platen surface 12*a* includes a plurality of intake holes, and air is sucked from the intake holes into the platen 12 at the timing of printing at the print head 8 such that the label sheet P adheres to the platen surface 12*a*.

The print head 8 is disposed in such a manner as to face the platen surface 12*a*. The print head 8 includes a nozzle row (not illustrated) corresponding to one or more ink colors, and discharges ink from nozzles constituting each nozzle row. The ink discharged by the nozzle is also referred to as a dot. The print head 8 performs printing on the label Pb by discharging ink to the label Pb located on the platen surface 12*a* based on print data. The label sheet P printed by the print head 8 is transported to the downstream peeling unit 4 by the transporting roller 11.

The guide 13 is disposed downstream of the print head 8. The guide 13 supports from below the label sheet P printed by the print head 8 between the platen 12 and the front surface of the printing unit 3. The label sheet P is transported toward the peeling unit 4 through the guide 13.

The peeling unit 4 includes a peeling member 30 and a peeling roller 31. The peeling member 30 is located downstream of the print head 8 of the printing unit 3. The peeling member 30 includes a guide surface 30*a* that supports the label sheet P from below by making contact with the backing sheet Pa of the label sheet P, and an acute-angled peeling edge 30*b* formed at the tip of the guide surface 30*a*. The label sheet P guided by the guide 13 is transported over the guide surface 30*a* of the peeling member 30.

The peeling roller 31 is composed of a pair of rollers facing each other, and transports the backing sheet Pa in a sandwiching manner. The peeling roller 31 is coupled, directly or with a gear, a belt or the like therebetween, to the peeling motor 34 described later, and is rotated by the power of the peeling motor 34.

In the case where the label printer 1 is operated in the peeling mode, the user performs an operation of sandwiching the backing sheet Pa of the label sheet P by the peeling roller 31 prior to the start of the printing. The peeling roller 31 is disposed below the peeling member 30 and transports the backing sheet Pa downward in a sandwiching manner. The backing sheet Pa of the label sheet P transported through the guide surface 30*a* is bent at the peeling edge 30*b* and pulled downward by the peeling roller 31. With the pulling force of the peeling roller 31, the label Pb is separated and peeled from the backing sheet Pa at the peeling edge 30*b*. The peeled label Pb protrudes out of the ejection port 4*a*. The label Pb protruding from the ejection port 4*a* is collected by the user. On the other hand, the backing sheet Pa transported by the peeling roller 31 in a direction different from the label Pb is ejected to the lower side of the peeling roller 31 in the example of FIG. 2.

With the above-described configuration, the feeding roller 10, the transporting roller 11, the platen 12, and the guide 13 form the transport path of the label sheet P in the printing unit 3. In addition, it can be said that the guide surface 30*a* and the peeling edge 30*b* of the peeling member 30 and the peeling roller 31 also form a part of the transport path.

Figure 3:
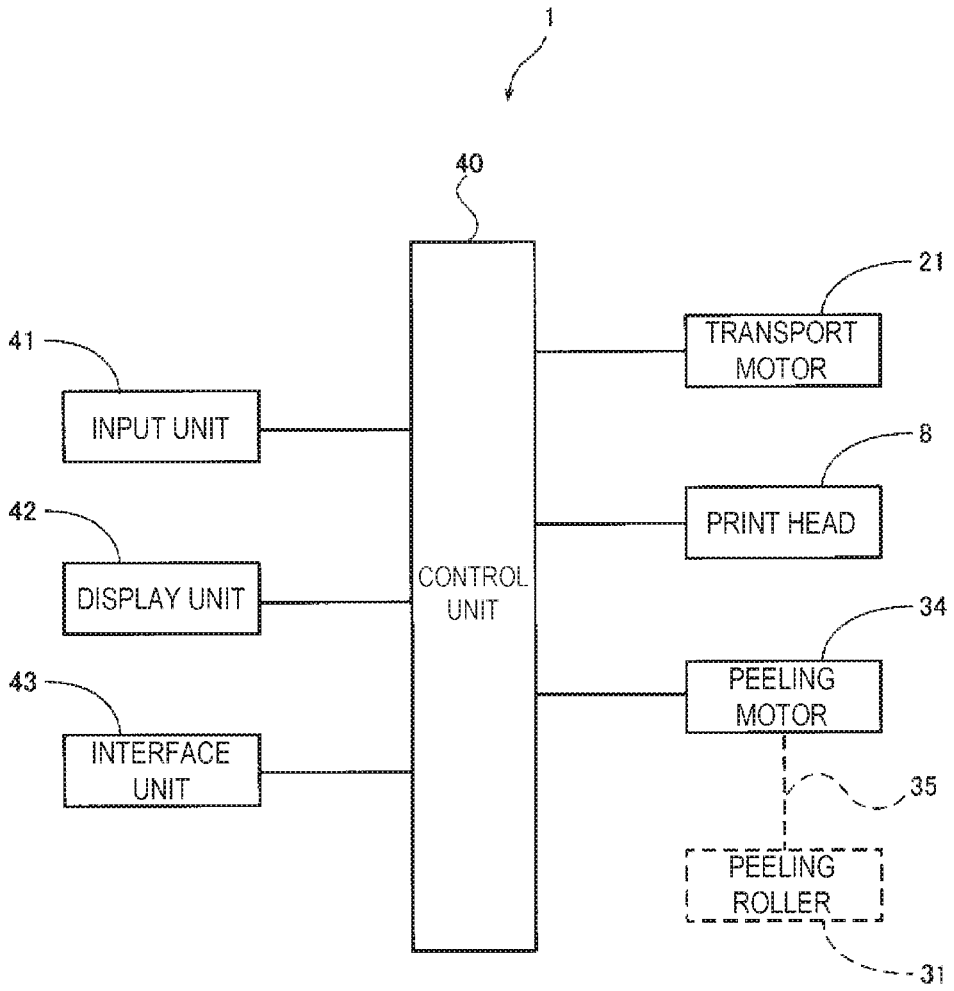
FIG. 3 is a block diagram illustrating a control system of the label printer.

FIG. 3 is a block diagram illustrating a control system of the label printer 1. The label printer 1 includes a control unit 40 that controls each part of the printing unit 3 and the peeling unit 4. In the control unit 40, a processor such as a CPU and a microcomputer controls each part of the label printer 1 by performing arithmetic processing in accordance with a program stored in a ROM or other memory, using a RAM as a work area.

The label printer 1 includes an input unit 41, a display unit 42, and an interface unit 43, and each of the components is coupled to the control unit 40. The control unit 40 is coupled to the print head 8, the transport motor 21, and the peeling motor 34 as operating units to be controlled. The print head 8, the transport motor 21, and the peeling motor 34 may each be coupled to the control unit 40 through a drive circuit that supplies power for driving. The control unit 40 controls each operating unit to perform transporting and printing of the label sheet P. A power transmission system 35 illustrated in FIG. 3 for transmitting the power of the peeling motor 34 to the peeling roller 31 is composed of a gear and/or a belt, and the power transmission system 35 does not include a torque limiter, unlike in JP-A-2018-2365.

The input unit 41 detects operations on the operation button 15 and the touch panel, and outputs a signal corresponding to the details of the detected operation to the control unit 40. The display unit 42 drives the display 16 and the lamp 17 in accordance with the control of the control unit 40 such that the display 16 displays characters and images and that the lamp 17 turns on or blinks. The interface unit 43 is connected to a host computer (not illustrated) in a wired or wireless manner, and communicates with the host computer in accordance with the control of the control unit 40. The interface unit 43 receives commands and print data transmitted by the host computer and outputs the commands and print data to the control unit 40.

For the configuration of the label printer 1, JP-A-2019-43561 may be appropriately referred to.

Figure 4:
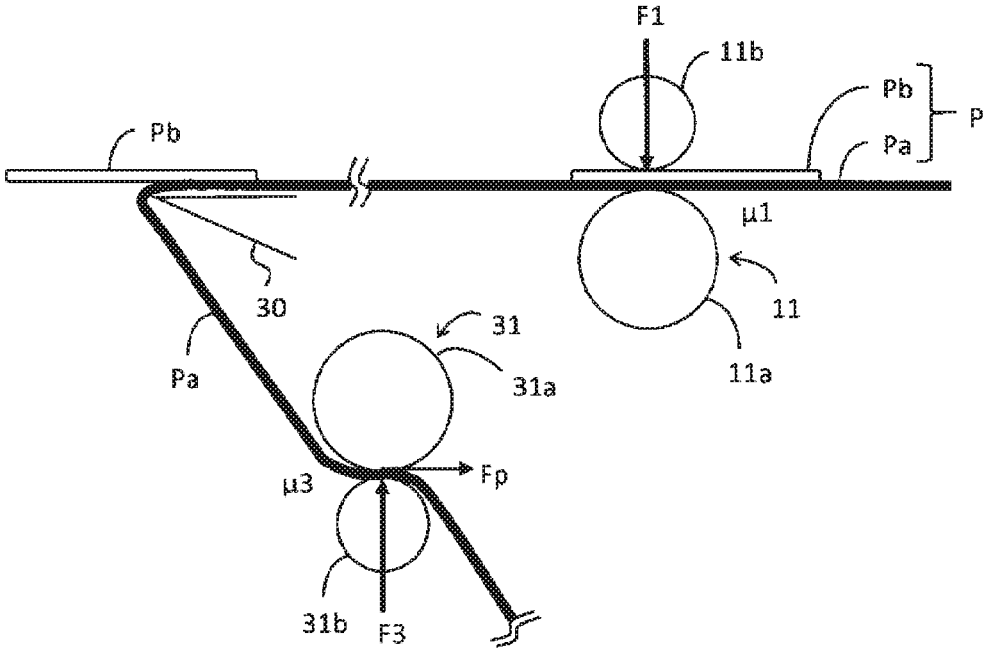
FIG. 4 is a drawing illustrating a partial range including a transporting roller and a partial range including a peeling roller.

FIG. 4 illustrates a partial range including the transporting roller 11 and a partial range including the peeling roller 31 in the label printer 1 from the same perspective as that of FIG. 2. In FIG. 4, most of the configuration illustrated in FIG. 2 is omitted.

The transporting roller 11 includes a first driving roller 11*a* and a first driven roller 11*b* that sandwich the label sheet P therebetween. The first driving roller 11*a* is rotated by the power of the transport motor 21. The first driven roller 11*b* is supported such that the first driven roller 11*b* is rotatable along with transport of the label sheet P by the rotation of the first driving roller 11*a*.

The peeling roller 31 includes a second driving roller 31*a* and a second driven roller 31*b* that sandwich the backing sheet Pa of the label sheet P therebetween. The second driving roller 31*a* is rotated by the power of the peeling motor 34. The second driven roller 31*b* is supported such that the second driven roller 31*b* is rotatable along with transport of the backing sheet Pa by the rotation of the second driving roller 31*a*.

In the transporting roller 11, the first driven roller 11*b* presses the first driving roller 11*a* with a force F1 in order to sandwich the label sheet P. Specifically, at the contact point with the label sheet P, the first driving roller 11*a* is pressed by the force F1 that is substantially perpendicular to the orientation of the label sheet P. The force F1 is described as a force per unit width (1 mm) that is obtained by dividing a pressing force of the first driven roller 11*b* on the first driving roller 11*a* by a width [mm] of the label sheet P of a reference. The unit of the force F1 is [gf/mm]. Forces F3, F4 and Fp described later are also forces per unit width as with the F1, and the unit thereof is [gf/mm]. Note that the unit [gf/mm] is appropriately omitted in the following description. The width of the label sheet P is the width of the label sheet P in the direction orthogonal to the longitudinal direction of the long label sheet P.

The static friction coefficient between the first driving roller 11*a* in contact with the backing sheet Pa of the label sheet P and the backing sheet Pa is $\mu 1$. Accordingly, when the force F1 is assumed as a normal force, the maximum friction force between the transporting roller 11 and the label sheet P can be represented as $\mu 1 \times F1$. The maximum friction force is also referred to as a maximum static friction force.

In the peeling roller 31, the second driven roller 31*b* presses the second driving roller 31*a* with a force F3 (gf/mm) in order to sandwich the backing sheet Pa. Specifically, at the contact point with the backing sheet Pa, the second driving roller 31*a* is pressed by the force F3 that is substantially perpendicular to the orientation of the backing sheet Pa. The static friction coefficient between the second driving roller 31*a* and the backing sheet Pa is $\mu 3$. Accordingly, when the force F3 is assumed as a normal force, the maximum friction force between the peeling roller 31 and the backing sheet Pa can be represented as $\mu 3 \times F3$.

The force F1 is set by adjusting an elastic member, such as a spring, that biases the first driven roller 11*b* toward the first driving roller 11*a*, for example. Likewise, the force F3 is set by adjusting an elastic member, such as a spring, that biases the second driven roller 31*b* toward the second driving roller 31*a*, for example. The static friction coefficient $\mu 1$ is set by selecting or adjusting the material, the surface state, and the like of the transporting roller 11. Likewise, the static friction coefficient $\mu 3$ is set by selecting or adjusting the material, the surface state, and the like of the peeling roller 31.

In such a situation, in the label printer 1, the maximum friction force $\mu 3 \times F3$ is set to a value smaller than the maximum friction force $\mu 1 \times F1$.

The backing sheet Pa of the label sheet P sandwiched by the transporting roller 11 is pulled downstream by the peeling roller 31. The force of the peeling roller 31 pulling the backing sheet Pa downstream is referred to as a transport force Fp of the peeling roller 31. When slack or deflection occurs in the backing sheet Pa in the transport path downstream of the transporting roller 11, it becomes difficult to peel the label Pb from the backing sheet Pa at the peeling unit 4. Therefore, the transport force Fp is required for reliably peeling the label Pb from the backing sheet Pa at the peeling unit 4.

A minimum transport force Fp required for peeling the label Pb by the peeling unit 4 is referred to as a transport force F4. The transport force F4 is smaller than the maximum friction force $\mu 3 \times F3$. That is, $F4 < \mu 3 \times F3 < \mu 1 \times F1$. In the state where the maximum friction force $\mu 1 \times F1$ is fixed, the transport force F4 is set to an appropriate value based on an experiment in which the peeling roller 31 pulls the backing sheet Pa to peel the label Pb at the peeling unit 4.

The transport force Fp changes in accordance with the current value supplied to the peeling motor 34 by the control unit 40 for driving the peeling motor 34. The peeling motor 34 is, for example, a DC motor. In response to increase in the current value supplied to the peeling motor 34, the torque of the peeling motor 34 increases, and the transport force Fp increases.

Here, when the transport force Fp generated by the peeling motor 34 is greater than the maximum friction force $\mu 3 \times F3$, slippage occurs between the second driving roller 31*a* and the backing sheet Pa, and the second driving roller 31*a*, i.e., the peeling roller 31 idles. Therefore, the control unit 40 controls the current to the peeling motor 34 such that the peeling roller 31 does not idle. Specifically, the control unit 40 controls the current value supplied to the peeling motor 34 such that the transport force Fp is equal to or greater than the transport force F4 and is equal to or smaller than $\mu 3 \times F3$.

2. Current Value Control

Figure 5:
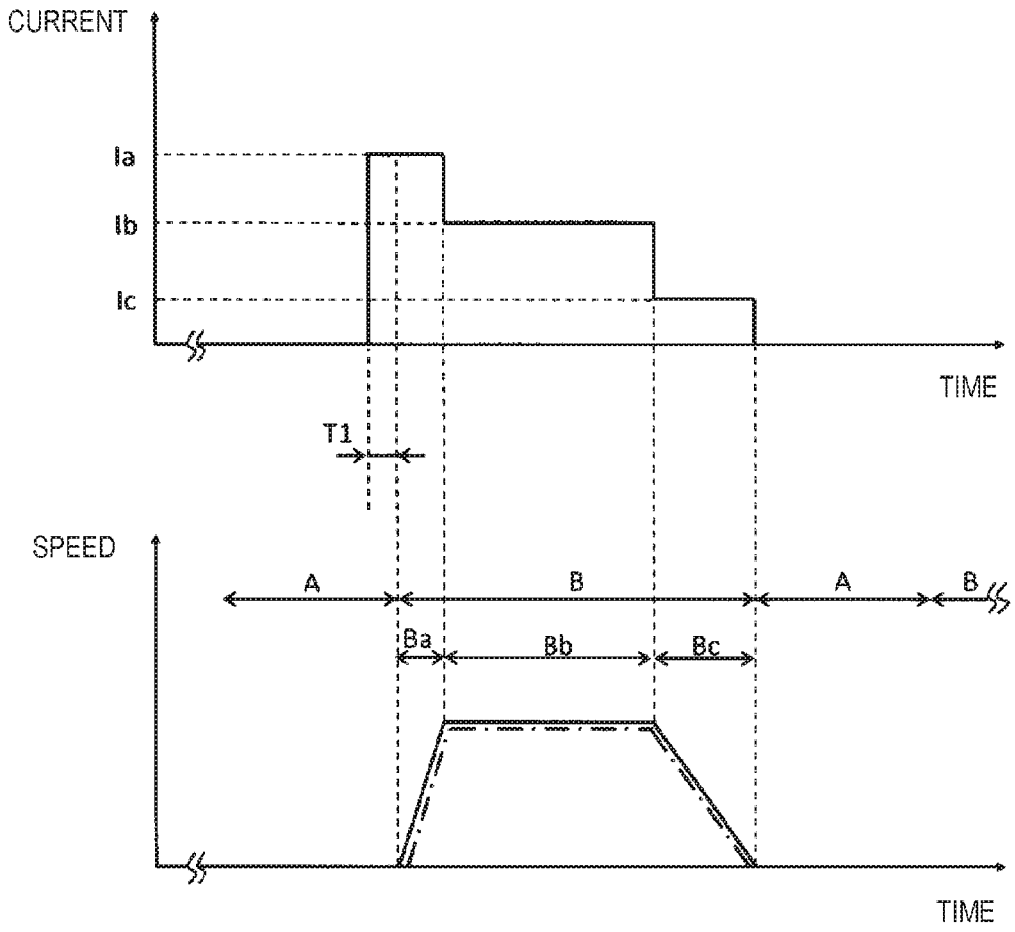
FIG. 5 is a diagram illustrating a change in a current value supplied to a peeling motor and a change in a rotational speed of the peeling roller.

In FIG. 5, the solid line graph on the upper side illustrates a change in the current value supplied to the peeling motor 34 by the control unit 40, and the solid line graph on the lower side illustrates a change in the rotational speed of the peeling roller 31. In FIG. 5, the upper graph and the lower graph are illustrated in such a manner that their time series, i.e., the horizontal axis, correspond to each other.

The processing period for the label sheet P of the label printer 1 that has selected the peeling mode is substantially divided into a printing period A and a transport period B. As illustrated in the lower graph of FIG. 5, the printing period A and the transport period B alternately occur. In the printing period A, the control unit 40 performs a single printing by driving the print head 8, basically without rotating each roller for transporting the label sheet P, such as the feeding roller 10, the transporting roller 11, and the peeling roller 31. The single printing is printing to the label Pb resting on the platen surface 12*a* among the labels Pb of the label sheet P.

In the transport period B, the control unit 40 rotates each roller for transporting the label sheet P by driving the transport motor 21 and the peeling motor 34 without driving the print head 8. In the transport period B, the control unit 40 performs the transport of the label sheet P by a predetermined distance required for setting, at a position on the platen surface 12*a*, the label Pb to be printed in the next printing period A. Along with the transport of the label sheet P in the transport period B, the label Pb after printing is peeled from the backing sheet Pa at the peeling unit 4.

The lower solid line graph in FIG. 5 has a trapezoidal shape, and therefore the transport period B of the peeling roller 31 is composed of an acceleration period Ba for acceleration from a speed 0 to a predetermined speed, a constant-speed period Bb for rotation at a predetermined speed, i.e., a constant speed, and a deceleration period Bc for deceleration from the predetermined speed to the speed 0. The acceleration period Ba, the constant-speed period Bb, and the deceleration period Bc in the transport period B have respective predetermined lengths. The control unit 40 supplies a preset current value to the peeling motor 34 to rotate the peeling roller 31 by the power of the peeling motor 34 such that the rotational speed of the peeling roller 31 changes as illustrated in the lower solid line graph of FIG. 5. Note that in this embodiment, "constant-speed period" is a period in which the rotational speed of the roller is controlled at a constant speed, and does not mean that the rotational speed of the roller during this period is exactly constant. Even in the constant-speed period, minor variation of the rotational speed of the roller naturally occurs.

As illustrated on the upper side in FIG. 5, in the transport period B, the control unit 40 first supplies a predetermined current value Ia to the peeling motor 34 for the acceleration period Ba to accelerate the peeling roller 31. Next, in the transport period B, the control unit 40 supplies a predetermined current value Ib, which is smaller than the current value Ia, to the peeling motor 34 for the constant-speed period Bb to stabilize the rotational speed of the peeling roller 31 at the predetermined speed. Next, in the transport period B, the control unit 40 supplies a predetermined current value Ic, which is smaller than the current value Ib, to the peeling motor 34 for the deceleration period Bc to decelerate the peeling roller 31.

Figure 6:
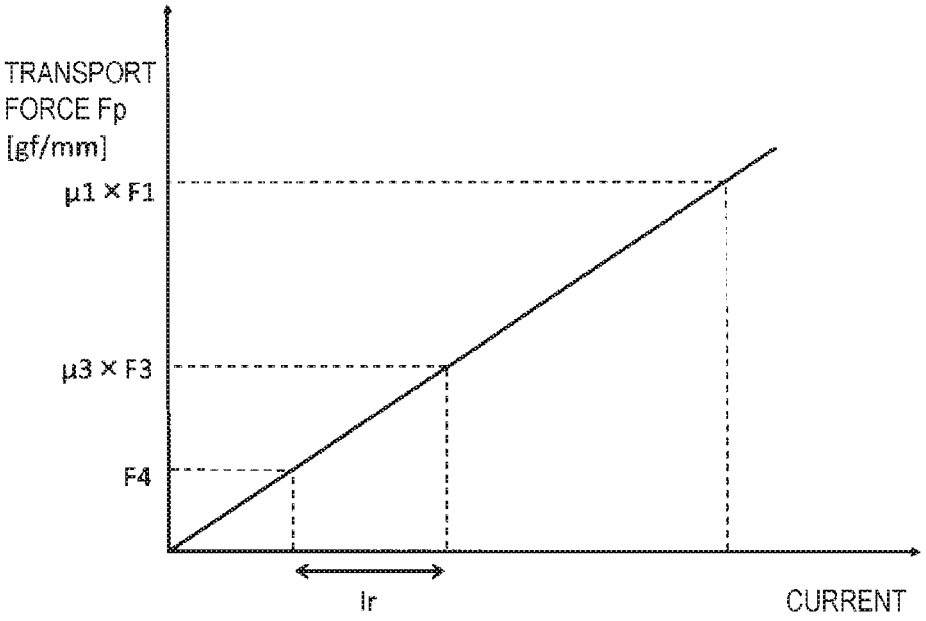
FIG. 6 is a diagram illustrating a relationship between a current value supplied to the peeling motor and a transport force of the peeling roller.

FIG. 6 is a graph illustrating a relationship between the current value supplied to the peeling motor 34 and the transport force Fp of the peeling roller 31. As described above, in this embodiment, $F4<\mu3\times F3<\mu1\times F1$. As the current value supplied to the peeling motor 34 increases, the transport force Fp increases. As described above, the control unit 40 controls the current to the peeling motor 34 such that the peeling roller 31 does not idle. Therefore, the control unit 40 supplies a current value of a range Ir corresponding to the maximum transport force Fp from the transport force F4 to the maximum friction force $\mu3\times F3$ to the peeling motor 34 in the transport period B. That is, the current values Ia, Ib, and Ic illustrated in the upper graph of FIG. 5 are current values that fall within the range Ir.

In the lower graph of FIG. 5, a change in the rotational speed of the transporting roller 11 is illustrated by a dot-dash line graph. In the transport period B, the control unit 40 controls the driving of the transport motor 21 to accelerate the rotational speed of the transporting roller 11 from 0, then rotates it at a constant speed, and thereafter decelerates it to the speed 0. In other words, the acceleration period Ba, the constant-speed period Bb, and the deceleration period Bc are the acceleration period, the constant-speed period, and the deceleration period for each roller. Although the control method of the transport motor 21 is not described in detail, the control unit 40 achieves the speed change of the transporting roller 11 as illustrated by the dot-dash line on the lower side in FIG. 5 by monitoring the rotation of the transport motor 21 via a rotary encoder (not illustrated) or the like, and by performing feedback control of the rotation of the transport motor 21 in accordance with the result of the monitoring, for example. The current values Ia, Ib, and Ic respectively supplied to the peeling motor 34 for the acceleration period Ba, the constant-speed period Bb, and the deceleration period Bc are preset values for changing the rotational speed of the peeling roller 31 at a rotational speed that is substantially the same as the rotational speed of the transporting roller 11 illustrated by the dot-dash line on the lower side in FIG. 5, or at a rotational speed slightly greater than the rotational speed of the transporting roller 11.

Figure 7:
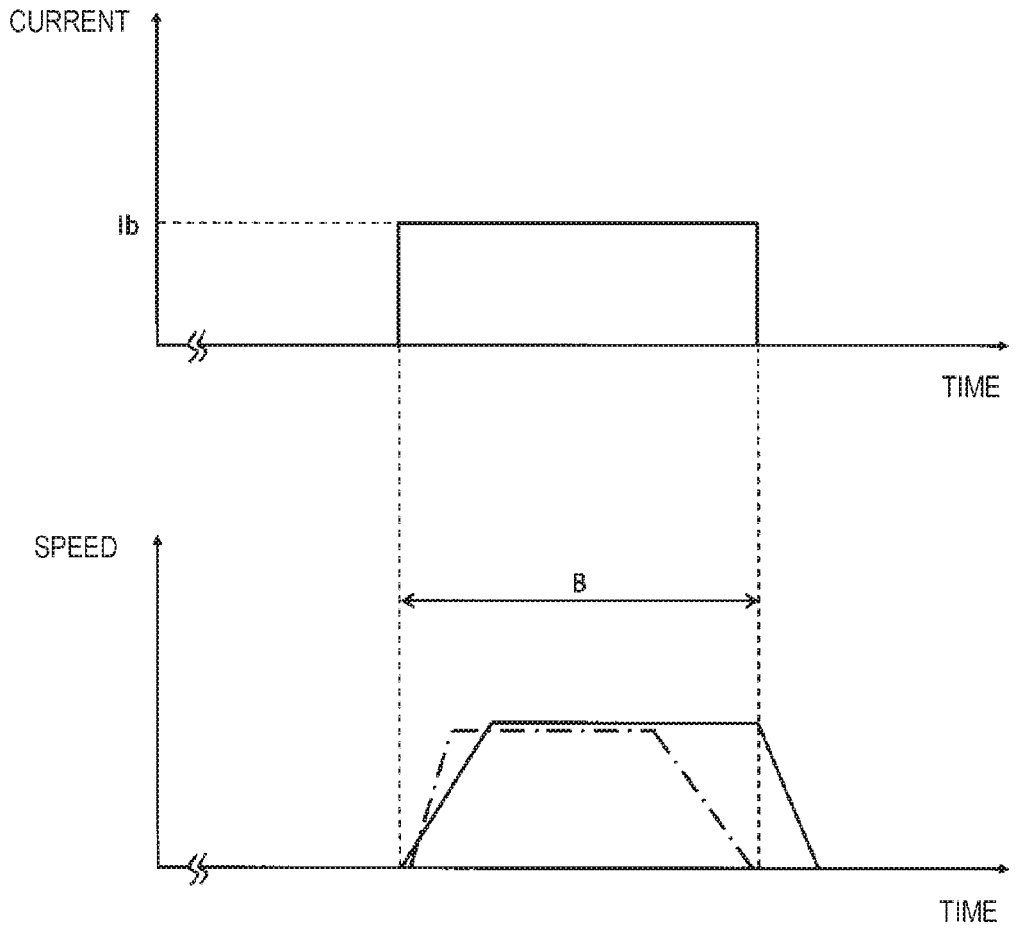
FIG. 7 is a diagram illustrating a known example for comparison with FIG. 5.

FIG. 7 illustrates a known example for comparison with FIG. 5, in which, as in FIG. 5, the solid line graph on the upper side illustrates a current value supplied by the control unit 40 to the peeling motor 34, and the solid line graph on the lower side illustrates a change in the rotational speed of the peeling roller 31. In addition, in the lower graph of FIG. 7, the dot-dash line graph illustrates a change in the rotational speed of the transporting roller 11 similar to that of the lower graph of FIG. 5. In the related art, a constant current value Ib is supplied in the transport period B to the peeling motor 34, which is a DC motor. As can be seen in FIGS. 5 and 7, the current value Ib is a current value required for rotating the peeling roller 31 at a constant speed of the predetermined speed.

However, in the configuration in which only the constant current value Ib is supplied to the peeling motor 34 in the transport period B, the peeling roller 31 takes a long time for the acceleration from the speed 0 to the predetermined speed, and consequently the acceleration of the peeling roller 31 tends to be delayed with respect to the acceleration of the transporting roller 11. When the acceleration of the peeling roller 31 is delayed with respect to the acceleration of the transporting roller 11, deflection of the label sheet P occurs on the transport path between the transporting roller 11 and the peeling roller 31 in a period within the transport period B. In addition, in the configuration in which only the constant current value Ib is supplied to the peeling motor 34 in the transport period B, it takes time until the rotational speed of the peeling roller 31 becomes 0 after the supply of the current value Ib is stopped at the timing of the end of the transport period B, and consequently the stop of the peeling roller 31 tends to be delayed with respect to the stop of the transporting roller 11. When the stop of the peeling roller 31 is delayed with respect to the stop of the transporting roller 11, the peeling roller 31 rotates and pulls downstream the label sheet P sandwiched by the transporting roller 11 in a period after the elapse of the transport period B, which may lead to errors in the transport of the label sheet P by the transporting roller 11.

In this embodiment, unlike such a known example, the control unit 40 supplies the current value Ia greater than the current value Ib to the peeling motor 34 in the acceleration period Ba of the transport period B as illustrated in FIG. 5. As a result, the rotational speed of the peeling roller 31 can be accelerated from the speed 0 to the predetermined speed in a shorter time. In addition, the control unit 40 supplies the current value Ic, which is smaller than the current value Ib, to the peeling motor 34 in the deceleration period Bc of the transport period B. As a result, the peeling roller 31 can be almost simultaneously stopped at the time when the supply of the current value to the peeling motor 34 is stopped at the end timing of the transport period B after the rotational speed of the peeling roller 31 is gradually reduced from the predetermined speed during the transport period B.

The control unit 40 may start the supply of the current value Ia to the peeling motor 34 at a timing earlier than the start of the acceleration period Ba by a predetermined time T1 as illustrated in the upper graph of FIG. 5. As described above, the acceleration period Ba is the acceleration period for each of the peeling roller 31 and the transporting roller 11. Therefore, by starting the supply of the current value Ia to the peeling motor 34 prior to the start of the acceleration period Ba, the rotation of the peeling roller 31 can be started at an earlier timing than the transporting roller 11.

By starting the rotation of the peeling roller 31 at an earlier timing than the transporting roller 11, even if there is a deflection in the label sheet P between the transporting roller 11 and the peeling roller 31, such deflection can be eliminated, and then the transport of the label sheet P by rotation of the transporting roller 11 and the peeling roller 31 can be started. By eliminating the deflection, the reliability of the peeling of the label Pb by the peeling unit 4 is increased. In the example of FIG. 5, the time T1 is included in the printing period A. Note that the time T1 may be included in the transport period B. In other words, the transport period B may be composed of a period whose length is time T1, the acceleration period Ba, the constant-speed period Bb, and the deceleration period Bc.

3. Summary

The label printer 1 of the embodiment includes the print head 8 configured to perform printing on the label sheet P including the label Pb attached to the backing sheet Pa, the transporting roller 11 disposed upstream of the print head 8 in the transport path of the label sheet P, and configured to rotate in a state where the transporting roller 11 is in contact with the label sheet P to transport the label sheet P downstream in the transport path, the peeling roller 31 disposed downstream of the print head 8 in the transport path, and configured to rotate in a state where the peeling roller 31 is in contact with the backing sheet Pa, the peeling roller 31 being configured to transport the backing sheet Pa in a direction different from a travelling direction of the label to peel the label from the backing sheet Pa, and the control unit 40 configured to control rotation of the transporting roller 11 and rotation of the peeling roller 31. When controlling a current value supplied to the peeling motor 34 that rotate the peeling roller 31 to accelerate rotation of the peeling roller 31 in a stopped state, to rotate the peeling roller 31 at a constant speed after acceleration, and to decelerate and stop the rotation of the peeling roller 31, the control unit 40 supplies the current value Ia to the peeling motor 34 such that the current value Ia supplied in the acceleration period Ba is greater than the current value in any of the constant-speed period Bb and the deceleration period Bc, the acceleration period Ba being a period in which the rotation of the peeling roller 31 is accelerated, the constant-speed period Bb being a period in which the peeling roller 31 is rotated at a constant speed, the deceleration period Bc being a period in which the rotation of the peeling roller 31 is decelerated.

With the above-described configuration, in the acceleration period Ba, the control unit 40 supplies, to the peeling motor 34, the current value Ia that is greater than the current value supplied in the constant-speed period Bb and the deceleration period Bc and thus the time period required for the acceleration of the peeling roller 31 is shortened in comparison with the related art. As a result, delay of the acceleration of the peeling roller 31 with respect to the acceleration of the transporting roller 11 can be prevented. In addition, according to this embodiment, the power transmission system 35 between the peeling motor 34 and the peeling roller 31 has a simple configuration provided with no torque limiter, and the time period required for acceleration of the peeling roller 31 can be shortened.

In addition, according to this embodiment, the control unit 40 may supply the electric current value Ic, which is smaller than in the constant-speed period Bb, to the peeling motor 34 in the deceleration period Bc.

With the above-described configuration, the control unit 40 supplies the current value Ic smaller than the current value Ib supplied in the constant-speed period Bb to the peeling motor 34 in the deceleration period Bc. Thus, the timing of the start of deceleration of the peeling roller 31 can be advanced and delay of the peeling roller 31 with respect to the stopping of the transporting roller 11 can be prevented.

Note that the setting of the current value Ic supplied to the peeling motor 34 in the deceleration period Bc to a value smaller than the current value Ib supplied to the peeling motor 34 in the constant-speed period Bb may not be essential.

In addition, according to this embodiment, a process achieved by the control unit 40 controlling the label printer 1 may be interpreted as a method and/or a program cooperating with hardware.

4. Modifications

Modifications of the embodiment will be described below.

First Modification

The transport force Fp of the peeling roller 31 changes in accordance with the current value supplied to the peeling motor 34. In addition, the relatively wide label sheet P and narrow label sheet P receive different forces per unit width of the label sheet P from the peeling roller 31 even when the same current value is supplied to the peeling motor 34. When the narrow label sheet P is used as the printing medium, it is necessary to reduce the power generated by the peeling motor 34 to avoid damage to the printing medium and the like.

In view of this, the control unit 40 may change the current value to be supplied to the peeling motor 34 in accordance with the width of the label sheet P. The user can input information about the label sheet P, such as the width of the label sheet P set in the label printer 1, to the label printer 1 by operating the operation button 15 and/or the touch panel. Alternatively, in some situation, a command transmitted from the host computer and received via the interface unit 43 includes information about the label sheet P. The control unit 40 acquires the width of the label sheet P through input of such information about the label sheet P by means of the input unit 41 and/or through reading of the information from the command.

The control unit 40 acquires the current values Ia, Ib, and Ic that should be supplied to the peeling motor 34 in the acceleration period Ba, the constant-speed period Bb, and the deceleration period Bc in the transport period B by referencing the acquired width information of the label sheet P and a current value table TB1 that defines the current value corresponding to the medium width. FIG. 8A illustrates an example of the current value table TB1. The current value table TB1 is stored in a predetermined memory in the label printer 1. According to FIG. 8A, the current value table TB1 defines current values Ia1, Ib1 and Ic1 as the current values Ia, Ib, and Ic of the case where the medium width, i.e., the width of the label sheet P, is equal to or smaller than a predetermined threshold value THw, and defines current values Ia2, Ib2 and Ic2 as the current values Ia, Ib, and Ic of the case where the medium width is greater than the threshold value THw.

Accordingly, when the width of the label sheet P is equal to or smaller than the threshold value THw, the control unit 40 supplies the current values Ia1, Ib1, and Ic1 to the peeling motor 34 for the acceleration period Ba, the constant-speed period Bb, and the deceleration period Bc, respectively. On the other hand, when the width of the label sheet P is greater than the threshold value THw, the control unit 40 supplies the current values Ia2, Ib2, and Ic2 to the peeling motor 34 for the acceleration period Ba, the constant-speed period Bb, and the deceleration period Bc, respectively. Note that, as can be seen from the description above, Ia1>Ib1>Ic1 and Ia2>Ib2>Ic2. In addition, Ia1<Ia2, Ib1<Ib2, and Ic1<Ic2.

The current value table TB1 illustrated in FIG. 8A defines the current values corresponding to medium widths equal to or smaller than the threshold value THw and current values corresponding to medium widths greater than the threshold THw, but may define current values corresponding to a more detailed classification of the medium width.

When switching the control of the peeling motor 34 in accordance with the width of the label sheet P as described above, the control unit 40 also switches the control of the transport motor 21 in accordance with the width of the label sheet P, and matches the rotational speeds of the transporting roller 11 and the peeling roller 31.

According to the first modification described above, the label sheet P can be transported with an optimal force in accordance with the width of the label sheet P while achieving the effects of the embodiment described above. Thus, damage to the narrow label sheet P and the like can be avoided, for example.

Second Modification

The control unit 40 may change the current value supplied to the peeling motor 34 in accordance with the setting of the transport speed of the label sheet P. The user can set the transport speed of the label sheet P in the label printer 1 by operating the operation button 15 and/or the touch panel. Examples of the setting of the transport speed include a low-speed mode for performing low-speed transport, and a high-speed mode for performing high-speed transport. Alternatively, in some situation, a command transmitted from the host computer and received via the interface unit 43 includes information about the setting of the transport speed. The control unit 40 acquires such a setting of the transport speed through input of the setting by means of the input unit 41 and/or through reading of the setting from the command.

The control unit 40 acquires the current values Ia, Ib, and Ic that should be supplied to the peeling motor 34 in the acceleration period Ba, the constant-speed period Bb, and the deceleration period Bc in the transport period B by referencing the acquired setting of the transport speed of the label sheet P and a current value table TB2 that defines the current value corresponding to the transport speed. FIG. 8B illustrates an example of the current value table TB2. The current value table TB2 is stored in a predetermined memory in the label printer 1. According to FIG. 8B, the current value table TB2 defines current values Ia3, Ib3, and Ic3 as the current values Ia, Ib, and Ic of the case where the transport speed is set to the low-speed mode, and defines current values Ia4, Ib4, and Ic4 as the current values Ia, Ib, and Ic of the case where the transport speed is set to the high-speed mode.

Accordingly, when the transport speed is set to the low-speed mode, the control unit 40 supplies the current values Ia3, Ib3, and Ic3 to the peeling motor 34 for the acceleration period Ba, the constant-speed period Bb, and the deceleration period Bc, respectively. On the other hand, when the transport speed is set to the high-speed mode, the control unit 40 supplies the current values Ia4, Ib4, and Ic4 to the peeling motor 34 for the acceleration period Ba, the constant-speed period Bb, and the deceleration period Bc, respectively. Note that Ia3>Ib3>Ic3 and Ia4>Ib4>Ic4. In addition, Ia3<Ia4, Ib3<Ib4, and Ic3<Ic4.

The current value table TB2 illustrated in FIG. 8B defines the current values corresponding to the low-speed mode and the current values corresponding to the high-speed mode, but may define current values corresponding to a more detailed classification of the setting of the transport speed.

When switching the control of the peeling motor 34 in accordance with the setting of the transport speed as described above, the control unit 40 also switches the control of the transport motor 21 in accordance with the setting of the transport speed, and matches the rotational speeds of the transporting roller 11 and the peeling roller 31.

According to the second modification described above, the effects of the embodiment described above can be achieved regardless of the setting of the transport speed.

In addition, a configuration combining the first modification and the second modification is also included in the embodiment. In other words, the control unit 40 may change the current value to be supplied to the peeling motor 34 in accordance with the combination of the width of the label sheet P and the setting of the transport speed.

Third Modification

The minimum transport force F4 required for peeling the label Pb by the peeling unit 4 differs depending on the type of label sheet P to be used. In view of this, the control unit 40 may change the current value to be supplied to the peeling motor 34 in accordance with the type of the label sheet P. Specifically, the control unit 40 changes the current value supplied to the peeling motor 34 in accordance with the minimum transport force F4 required for peeling the label Pb, which differs depending on the type of the label sheet P. When the transport force F4 is relatively small, the label sheet P is of a type whose label Pb is easily peeled, and when the transport force F4 is relatively large, the label sheet P is of a type whose label Pb is not easily peeled. The magnitude of the transport force F4 indirectly indicates the type of the label sheet P.

The user can input, to the label printer 1, information about the minimum transport force F4 required for peeling the label Pb of the label sheet P set in the label printer 1 by operating the operation button 15 and/or the touch panel. Alternatively, in some situation, a command transmitted from the host computer and received via the interface unit 43 includes information about the minimum transport force F4 required for peeling the label Pb of the label sheet P. The control unit 40 acquires the transport force F4 through input of such information about the transport force F4 for the label sheet P by means of the input unit 41 and/or through reading of the information from the command. The control unit 40 acquires the current values Ia, Ib, and Ic that should be supplied to the peeling motor 34 in the acceleration period Ba, the constant-speed period Bb, and the deceleration period Bc in the transport period B by referencing information about the acquired transport force F4 and a current value table TB3 that defines the current value corresponding to the transport force F4.

FIG. 8C illustrates an example of the current value table TB3. The current value table TB3 is stored in a predetermined memory in the label printer 1. According to FIG. 8C, the current value table TB3 defines current values Ia5, Ib5, and Ic5 as the current values Ia, Ib, and Ic of the case where the transport force F4 is equal to or smaller than a predetermined threshold value THf, and defines current values Ia6, Ib6, and Ic6 as the current values Ia, Ib, and Ic of the case where the transport force F4 is greater than the threshold value THf. Accordingly, when the transport force F4 for the label sheet P is equal to or smaller than the threshold value THf, the control unit 40 supplies the current values Ia5, Ib5, and Ic5 to the peeling motor 34 for the acceleration period Ba, the constant-speed period Bb, and the deceleration period Bc, respectively. On the other hand, when the transport force F4 for the label sheet P is greater than the threshold value THf, the control unit 40 supplies the current values Ia6, Ib6, and Ic6 to the peeling motor 34 for the acceleration period Ba, the constant-speed period Bb, and the deceleration period Bc, respectively. Note that, as can be seen from the description above, Ia5>Ib5>Ic5, and Ia6>Ib6>Ic6. In addition, Ia5<Ia6, Ib5<Ib6, and Ic5<Ic6.

The current value table TB3 illustrated in FIG. 8C defines the current values corresponding to the transport force F4 equal to or smaller than the threshold value THf, and the current values corresponding to the transport force F4 greater than the threshold value THf, but may define current value for each type of the medium. Naturally, the current value table TB3 may define current values corresponding to mediums of two or more types. When switching the control of the peeling motor 34 in accordance with the type of the label sheet P as described above, the control unit 40 also switches the control of the transport motor 21 in accordance with the type of the label sheet P, and matches the rotational speeds of the transporting roller 11 and the peeling roller 31. According to the third modification described above, the effects of the embodiment described above can be achieved regardless of the type of the label sheet P to be used. In addition, a configuration combining the first modification, the second modification, and the third modification is also included in the embodiment. In other words, the control unit 40 may change the current value to be supplied to the peeling motor 34 in accordance with the combination of the width of the label sheet P, the transport speed, and the type of the label sheet P.

What is claimed is:

1. A label printer comprising:

a print head configured to perform printing on a label sheet including a label attached to a backing sheet;

a transporting roller disposed upstream of the print head in a transport path of the label sheet, and configured to rotate in a state where the transporting roller is in contact with the label sheet to transport the label sheet downstream in the transport path;

a peeling roller disposed downstream of the print head in the transport path, and configured to rotate in a state where the peeling roller is in contact with the backing sheet, the peeling roller being configured to transport the backing sheet in a direction different from a travelling direction of the label to peel the label from the backing sheet; and a control unit configured to control rotation of the transporting roller and rotation of the peeling roller, wherein the control unit is configured to control a current value supplied to a peeling motor that rotates the peeling roller to be one of (1) 0, (2) a first value, (3) a second value that is lower than the first value, or (4) a third value that is lower than the second value, when the control unit sets the current value to 0, the peeling roller is in a stopped state, when the control unit changes the current value from 0 to the first value, the peeling roller switches from the stopped state to an acceleration state, causing the peeling roller to accelerate to a particular speed, a time when the current value changes from 0 to the first value is earlier than a time when the peeling roller switches from the stopped state to the acceleration state, when the control unit changes the current value from the first value to the second value, the peeling roller switches from the acceleration state to a constant speed state, causing the peeling roller to rotate the particular speed after acceleration for a period, when the control unit changes the current value from the second value to the third value, the peeling motor switches from the constant speed state to a deceleration state, causing the peeling roller to decelerate from the particular speed to 0, and when the control unit changes the current value from the third value to 0, the peeling motor switches from the deceleration state to the stopped state.

2. The label printer according to claim 1, wherein in the deceleration period, the control unit supplies a current value smaller than the current value in the constant-speed period to the peeling motor.

3. The label printer according to claim 1, wherein the control unit changes the current value supplied to the peeling motor in accordance with a width of the label sheet.

4. The label printer according to claim 1, wherein the control unit changes the current value supplied to the peeling motor in accordance with a setting of a transport speed of the label sheet.

5. The label printer according to claim 1, wherein the control unit changes the current value supplied to the peeling motor in accordance with a type of the label sheet.

* * * * *